US010526677B2

(12) United States Patent
Frost et al.

(10) Patent No.: US 10,526,677 B2
(45) Date of Patent: Jan. 7, 2020

(54) HEAT TREATMENT FURNACE AND METHOD FOR HEAT TREATMENT OF A PRE-COATED STEEL SHEET BLANK AND METHOD FOR PRODUCTION OF A MOTOR VEHICLE PART

(71) Applicant: Benteler Automobiltechnik GmbH, Paderborn (DE)

(72) Inventors: Georg Frost, Steinheim (DE); Markus Kettler, Paderborn (DE); Karsten Bake, Delbrueck (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 331 days.

(21) Appl. No.: 15/385,835

(22) Filed: Dec. 20, 2016

(65) Prior Publication Data

US 2017/0183754 A1 Jun. 29, 2017

(30) Foreign Application Priority Data

Dec. 23, 2015 (DE) ..... 10 2015 122 827
Jan. 15, 2016 (DE) ..... 10 2016 100 648

(51) Int. Cl.
*C21D 9/46* (2006.01)
*C21D 9/00* (2006.01)
(Continued)

(52) U.S. Cl.
CPC ..... *C21D 9/46* (2013.01); *C21D 6/00* (2013.01); *C21D 9/005* (2013.01); *C21D 9/0056* (2013.01);
(Continued)

(58) Field of Classification Search
CPC ..... C21D 9/46; C21D 9/005; C21D 9/0056; C21D 9/0062; C21D 6/00; F27D 3/0024; F27D 9/00; F27D 13/00
See application file for complete search history.

(56) References Cited

U.S. PATENT DOCUMENTS 8,307,680 B2 * 11/2012 Drillet ..... B32B 15/012 72/47
8,721,809 B2 * 5/2014 Vlot ..... B32B 15/013 148/533
(Continued)

FOREIGN PATENT DOCUMENTS

CN 102482725 A 5/2012
CN 103827325 A 5/2014
(Continued)

OTHER PUBLICATIONS

Chinese Office Action for Application No. 201611273126.1, dated Feb. 7, 2018, 10 pages.
(Continued)

*Primary Examiner* — Cam N. Nguyen
(74) *Attorney, Agent, or Firm* — Hauptman Ham, LLP

(57) ABSTRACT

A heat treatment furnace and a method for heat treatment of a steel sheet blank is disclosed having at least one furnace chamber and a transport system for conveying the steel sheet blanks through the furnace chamber. A preheating chamber, a metallurgical bonding path and a cooling chamber, wherein the steel sheet blank can be heated in the preheating chamber to a temperature of above 200° C. A method for the production of a hot-formed and press-quenched motor-vehicle part is also disclosed.

13 Claims, 6 Drawing Sheets

Figures 1A, 1B:
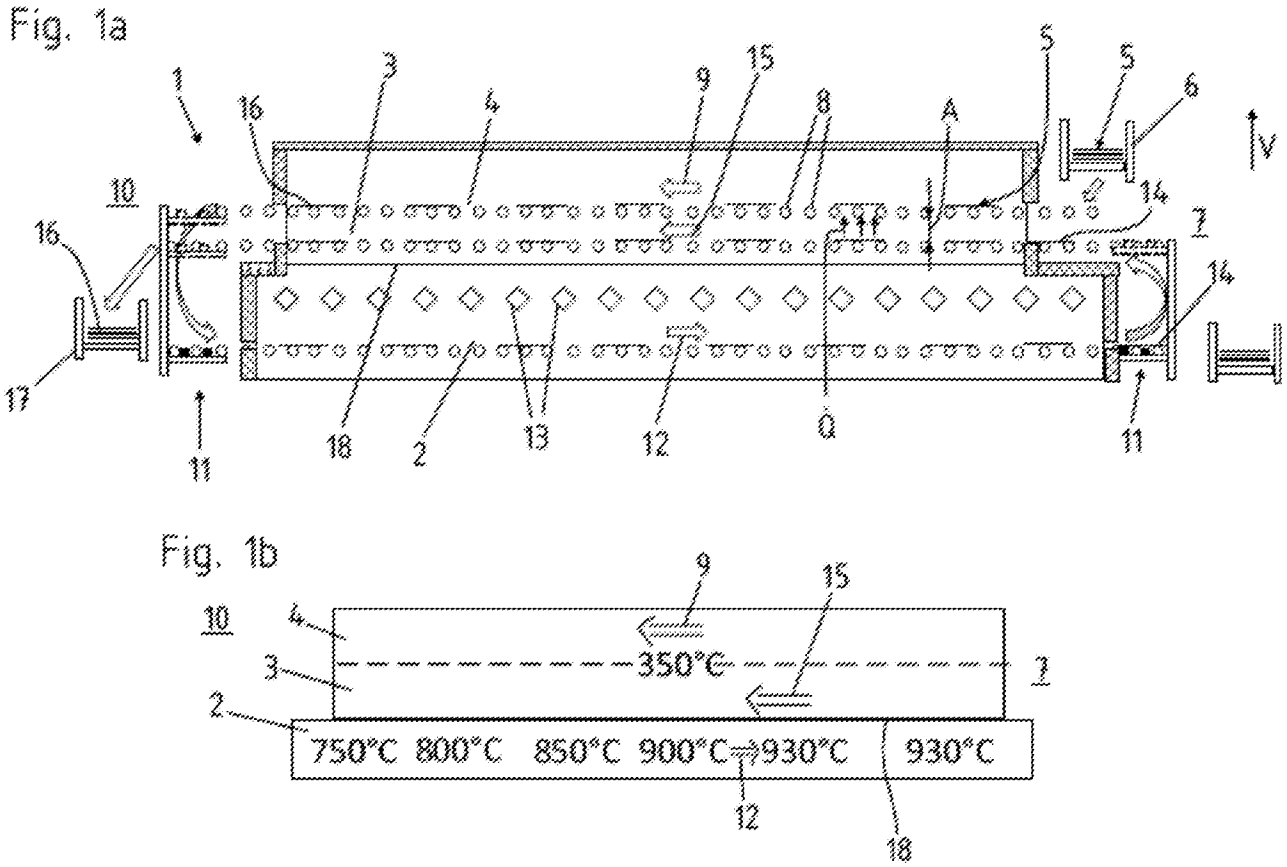

(51) Int. Cl.

| | |
|---|---|
| ***C21D 6/00*** | (2006.01) |
| ***F27D 3/00*** | (2006.01) |
| ***F27D 9/00*** | (2006.01) |
| ***F27D 13/00*** | (2006.01) |

(52) U.S. Cl.

CPC ..... *C21D 9/0062* (2013.01); *F27D 3/0024* (2013.01); *F27D 9/00* (2013.01); *F27D 13/00* (2013.01); *F27D 2003/0075* (2013.01); *F27D 2009/0075* (2013.01)

(56) References Cited

U.S. PATENT DOCUMENTS

| | | | | |
|---|---|---|---|---|
| 9,038,429 | B2 * | 5/2015 | Li | C21D 8/1283 72/200 |
| 9,255,313 | B2 * | 2/2016 | Cho | C21D 1/48 |
| 9,475,112 | B2 * | 10/2016 | Naitou | B21D 22/208 |
| 9,481,916 | B2 * | 11/2016 | Vlot | B32B 15/013 |
| 9,512,499 | B2 * | 12/2016 | Tomokiyo | C21D 9/46 |
| 9,598,745 | B2 * | 3/2017 | Hayashi | C21D 8/0226 |
| 9,611,530 | B2 * | 4/2017 | Bello | C23C 2/26 |
| 9,689,050 | B2 * | 6/2017 | Bouaziz | C21D 6/02 |
| 9,694,408 | B2 * | 7/2017 | Trippe | B21D 22/022 |
| 9,840,751 | B2 * | 12/2017 | Hayashi | C21D 8/0226 |
| 2002/0069506 | A1 | 6/2002 | Brodt et al. | |
| 2013/0189634 | A1 | 7/2013 | Bors | |
| 2014/0345753 | A1 | 11/2014 | Bors | |
| 2016/0145707 | A1 | 5/2016 | Feuser et al. | |

FOREIGN PATENT DOCUMENTS

| | | | |
|---|---|---|---|
| CN | 103993137 | A | 8/2014 |
| CN | 104769138 | A | 7/2015 |
| DE | 10 2009 050 879 | B3 | 9/2011 |
| DE | 102011120681 | A1 | 6/2013 |
| DE | 10 2012 006 017 | A1 | 9/2013 |
| DE | 10 2012 221 120 | A1 | 5/2014 |
| DE | 102013010946 | B3 | 12/2014 |
| DE | 10 2014 002 258 | A1 | 9/2015 |
| DE | 10 2014 112 448 | A1 | 12/2015 |
| EP | 1195208 | A2 | 4/2002 |
| EP | 1195208 | A3 | 12/2004 |
| EP | 2548975 | A1 | 1/2013 |
| EP | 2806041 | A2 | 11/2014 |
| EP | 2824216 | A1 | 1/2015 |
| EP | 2806041 | A3 | 4/2015 |
| KR | 20100001179 | A | 1/2010 |

OTHER PUBLICATIONS

Office Action for European Application No. 16205353.2 dated Jun. 17, 2019; 10pp.

Office Action for Chinese Application No. 201611273126.1 dated Nov. 16, 2018; 15pp.

* cited by examiner

HEAT TREATMENT FURNACE AND METHOD FOR HEAT TREATMENT OF A PRE-COATED STEEL SHEET BLANK AND METHOD FOR PRODUCTION OF A MOTOR VEHICLE PART

RELATED APPLICATIONS

The present application claims priority to German Application Number 10 2015 122 827.0 filed Dec. 23, 2015 and German Application Number 10 2016 100 648.3 filed Jan. 15, 2016, the disclosure of which is hereby incorporated by reference herein in its entirety.

The present invention relates to a heat treatment furnace.

The invention also relates to a method for heat treatment of a coated steel blank.

The invention also relates to a method for production of a motor vehicle part.

Hot-forming and press-quenching technology is known from the prior art. In this context, a sheet metal blank made of a quenchable steel alloy is heated to a temperature above the Ac3 temperature, which generally corresponds to above 900° C. The steel sheet blank, which is at that temperature, is then placed in a hot-forming tool and is formed in this hot state. After forming, the formed steel sheet product is held in the hot-forming tool or is transferred to a separate press-quenching tool and rapidly cooled so as to harden the material structure.

This has the drawback that although the steel sheet product produced in this manner does have, at least in part, high hardness, it is susceptible to corrosion. Since these parts are used specifically in the body construction of motor vehicles, an appropriate corrosion protection measure must be adopted. The parts produced are provided with an anti-corrosion coating, for example in a CDP process.

It is however also known to provide pre-coated steel sheet blanks which for example have an aluminum silicon (Al—Si) coating. These are heat treated such that the pre-coating and the steel sheet blank are metallurgically bonded, thus creating an anti-corrosion coating on the produced part. At the same time, the pre-coating is also provided as scale protection.

This has the drawback that, specifically in the case of thin sheet metal blanks and/or partially rolled sheet metal blanks, hydrogen-induced tensile crack formation can arise during the heating of the pre-coated blank that precedes the hot-forming. This is also known as hydrogen embrittlement or delayed cracking. This can also lead to cracks appearing after hot-forming and press-quenching.

The present invention therefore has the object of indicating a possible way of avoiding, as far as possible, the hydrogen embrittlement that arises in pre-coated steel sheet blanks for a subsequent hot-forming and press-quenching process. It is possible to process constant-thickness steel sheet blanks but also steel sheet blanks of differing thickness.

The above-mentioned object is achieved according to the invention with a heat treatment furnace.

The method part of the object is moreover achieved with a method for heat treatment of a pre-coated steel sheet blank.

The further method part of the object is achieved with a method for production of a motor vehicle part.

Advantageous embodiment variants of the invention are described in the subclaims.

The present invention provides that a pre-coated steel sheet blank is first preheated, then metallurgically bonded with the pre-coating and then the blank that is metallurgically bonded with the coating is cooled in a targeted manner. Only after this does the actual heating in preparation for hot-forming take place. In that context, cooling is not performed too rapidly, such that the diffusible hydrogen atoms that are present in the blank can defuse out of the material. This establishes a hydrogen content of less than 0.5 ppm, preferably less than 0.3 ppm.

It is thus possible that the steel sheet blanks, heated and coated according to this inventive concept, have a markedly reduced hydrogen content and thus the risk of hydrogen-induced tensile cracking is almost completely avoided. Subsequent heating, in particular rapid heating, of the coated steel sheet blank together with austenization thus almost completely avoids the risk of hydrogen-induced tensile cracking.

To that end, the heat treatment furnace for coated steel sheet blanks has at least one furnace chamber and a transport system for guiding the steel sheet blanks through the furnace chamber. It is characterized, according to the invention, in that there are provided a preheating chamber, a metallurgical bonding path and a cooling chamber, wherein the pre-coated steel sheet blank can be heated in the preheating chamber to a temperature of above 200° C., can be heated in the metallurgical bonding path to a temperature above Ac3, and can be cooled in the cooling chamber to a temperature of below 450° C. in a controlled manner.

Preferably, to that end at least the metallurgical bonding path is designed as a continuous furnace with one furnace chamber. However, in another preferred embodiment variant, the preheating chamber and the cooling chamber are also respectively designed as a preheating path and a cooling path according to the principle of a continuous furnace.

In order that the heat treatment furnace can be operated economically with regard to the required installation space in an assembly hall and also with regard to energy considerations, it is provided that the preheating path, the metallurgical bonding path and the cooling path are arranged in a continuous furnace, in particular in parallel one above the other or in parallel next to one another.

The heat treatment furnace according to the invention is in particular characterized in that the metallurgical bonding path is primarily heated by heat sources or heating sources arranged therein. Heating is for example effected by means of radiative heaters, heating cartridges, induction, conduction, burner heating and/or in a similar manner. Thus, an air recirculator can be provided in the metallurgical bonding path. The parallel arrangement of the preheating path and the cooling path makes it possible for the heat energy, in particular excess heat energy, of the metallurgical bonding path to also be used in the preheating path and/or the cooling path. To that end, a temperature-permeable separating layer is provided. This can for example be a perforated plate or another, in particular physical, separating layer which permits temperature permeability that is pre-configured in a targeted manner, or can be subject to closed-and/or open-loop control. This allows part of the heat energy in the metallurgical bonding path to be transferred to the preheating path and/or to the cooling path. Furthermore, a reduced distance between the cooling path and the preheating path means that the heat radiation from the steel sheet blanks that are to be cooled can be used to heat the steel sheet blanks that are transported in the preheating path.

Manipulators are provided at the respective end of the heat treatment furnace such that the individual paths of the heat treatment furnace can be passed through in particular according to the contraflow or counter-current principle. In particular in the case of paths that are arranged one above the other with regard to the vertical direction, vertical conveyors are used, and in the case of paths that are arranged next to one another with regard to the vertical direction, horizontal conveyors are used.

Within the context of the invention, path is to be understood as the metallurgical bonding path, the cooling path and the preheating path.

However, other designs can also be used for both the cooling chamber and the preheating chamber. For example, for the preheating chamber use can be made of a multiple hearth furnace, a rotary furnace or a paternoster furnace, that is to say a vertical conveyor furnace.

The cooling chamber can also be of multiple hearth design. Also particularly preferred, when the preheating chamber and/or the cooling chamber are arranged separate from the metallurgical bonding path, is that the exhaust air from the metallurgical bonding path is routed into the preheating chamber and/or the cooling chamber.

The present invention is further characterized by a method for heat treatment of a coated steel sheet blank, wherein a pre-coated steel sheet blank is metallurgically bonded. The method is in particular carried out in an above-described heat treatment furnace. It is characterized by the following method steps:

- heating the pre-coated steel sheet blank from room temperature to a preheat temperature of greater than 200° C.,
- then heating to a metallurgical bonding temperature above the Ac3 temperature, such that the pre-coating is metallurgically bonded,
- then cooling the metallurgically bonded steel sheet blank to a cooling temperature of less than 450° C. in a time of greater than 30 s, in particular greater than 90 s,
- then storing or further processing the cooled steel sheet blank.

The method according to the invention thus makes it possible, in particular, to decouple the metallurgical bonding of the steel sheet blank from the actual hot-forming and press-quenching process.

In particular, this preheating temperature is above 250° C., in particular at a temperature between 250° C. and 450° C.

Thereafter, the pre-coated and preheated steel sheet blank is heated from the preheat temperature to a temperature (metallurgical bonding temperature) above the Ac3 temperature and optionally held there in order that the pre-coating fully metallurgically bonds to the surface of the steel sheet blank. This involves a metallurgical bond with the pre-coating so as to form an intermetallic phase with the steel sheet blank.

After metallurgical bonding, the invention provides for targeted cooling to be carried out in a cooling chamber and/or a cooling path. This is brought about by targeted cooling to a cooling temperature below 450° C., in particular between 450° C. and 300° C. Also, and particularly preferably, two-stage cooling can be carried out. In particular, cooling is thus first carried out in a slow and controlled manner to a cooling temperature. This takes place slower than cooling in air at room temperature. Once the cooling temperature has been reached, further active rapid cooling can take place. The slow cooling thus allows the hydrogen to slowly diffuse out. The subsequent rapid cooling avoids warping of the blank.

Furthermore, the cooling path and the preheating path being arranged in parallel one above the other or next to one another, at least in certain sections, in the transport direction, means that the heat radiation from the steel sheet blanks that are to be cooled can be used to heat the steel sheet blanks that are transported through the preheating path.

In a further preferred manner, heating to metallurgical bonding temperature, that is to say heating for metallurgical bonding, from the preheat temperature for metallurgical bonding is carried out as rapid heating, in a time of less than 20 s/mm of sheet thickness of the pre-coated steel sheet blank. In particular at a time of less than 10 s per mm of sheet thickness, preferably less than 5 s per mm of sheet thickness. At the same time, heating from the preheat temperature to above the Ac3 temperature is carried out in the above-described time span. Sheet thicknesses deviating unevenly from a full millimeter can be interpolated appropriately.

Also, and particularly preferably, cooling from heating temperature to cooling temperature is carried out in a time of greater than 30 s per mm of sheet thickness of the sheet metal blank that is to be cooled.

In particular, it is thus possible to generate a coating layer thickness of less than 0.6 μm, the layer thickness being preferably greater than 0.15 μm. Particularly preferably, a layer thickness of between 10 μm and 35 μm is created.

Alternatively or in addition, the fraction of atomic hydrogen is less than 0.5 ppm, in particular less than 0.3 ppm. In particular, this indication relates to the hydrogen content in the steel material of the metallurgically bonded steel sheet blank. It is thus possible, with the method according to the invention, to heat treat a steel sheet bank made of a quenchable steel alloy and pre-coated with an aluminum-silicon alloy so as to form an intermetallic phase, in particular with an iron-aluminum fraction, between the steel sheet blank and the pre-coating. In particular, the method for heat treating the coated sheet metal blank is used for homogeneous heat treatment thereof.

The steel sheet blank homogeneously heat-treated in this manner can then be processed, in a subsequent hot-forming and press-quenching process, to give a quenched steel part, in particular a motor vehicle part. In particular, the secondary heating takes place as rapid heating. This is characterized in that the coated and metallurgically bonded steel sheet blank, which is to be reheated after heat treatment, is heated to the austenization temperature, that is to say the Ac3 temperature, in a time of less than 20 s, preferably less than 10 s, in particular less than 5 s. In particular, heating takes place in a time of less than 20 s per mm, preferably less than 10 s per mm, particularly preferably less than 5 s per mm of sheet thickness of the steel sheet blank that is to be heated. This avoids hydrogen diffusing back in. Thus, the hydrogen content is set at less than 0.5 ppm, preferably less than 0.3 ppm, even in the hot-formed and press-quenched part. The rapid heating can be effected in particular using contact plates or induction or also by direct resistance heating. Thereafter, the coated austenized steel sheet blank is hot-formed and press-quenched. Preferably, a part having a tensile strength Rm of greater than 1250 MPa, in particular greater than 1450 MPa is produced.

The previously mentioned part is in particular a sheet metal formed part, very particularly preferably a motor vehicle part. It is in particular produced such that the heat treated and metallurgically bonded steel sheet blank produced by means of the previously described method has an atomic hydrogen content of less than 0.5 ppm, in particular 0.3 ppm. The metallurgically bonded steel sheet blank is either supplied directly after heat treatment to a hot-forming and press-quenching process, or alternatively stored therebetween. Therefore, either the steel sheet blank is heated from the cooling temperature, for example in a range between 450° C. and 100° C., back above Ac3 for the subsequent hot-forming process, or is heated from room temperature to above Ac3 if the sheet metal blank is taken from the store.

Heating to above Ac3 takes place at least in certain regions and in particular entirely by means of a rapid heating process. This means that the steel sheet blank is heated from its current temperature to a temperature equal to or above the Ac3 temperature in a time of less than than 20 s, preferably less than 10 s, in particular less than 5 s. This can for example take place by means of contact heating, but also by means of induction or as direct resistance heating. The rapid heating in turn allows that no hydrogen in the surrounding air can penetrate into the coating, the intermetallic phase formed between the coating and the steel sheet blank, or the steel sheet blank itself. This avoids brittle breakages arising after hot-forming and press-quenching.

The motor vehicle part produced in this manner therefore has an atomic hydrogen fraction of less than 0.5 ppm, in particular less than 0.3 ppm. More preferably, it is thus possible to produce a high-strength, a super high-strength or preferably an ultra high-strength formed steel part. The indication expressed in ppm is preferably to be understood, within the context of this invention, as an indication in terms of mass relative to the entire motor vehicle part. In particular, the hydrogen content is also present in the quenched regions. The indication in ppm thus relates to the total mass of the produced motor vehicle part;

$$\text{ppm} = \mu\text{g of hydrogen/g of motor vehicle part.}$$

The motor vehicle part has, in certain regions and in particular throughout, a tensile strength Rm of greater than 1250 MPa, in particular greater than 1450 MPa. The tensile strength should be limited by the tensile strengths that can be technically achieved. In particular, the tensile strength is thus less than 3000 MPa, preferably less than 2000 MPa.

Figure 2A:
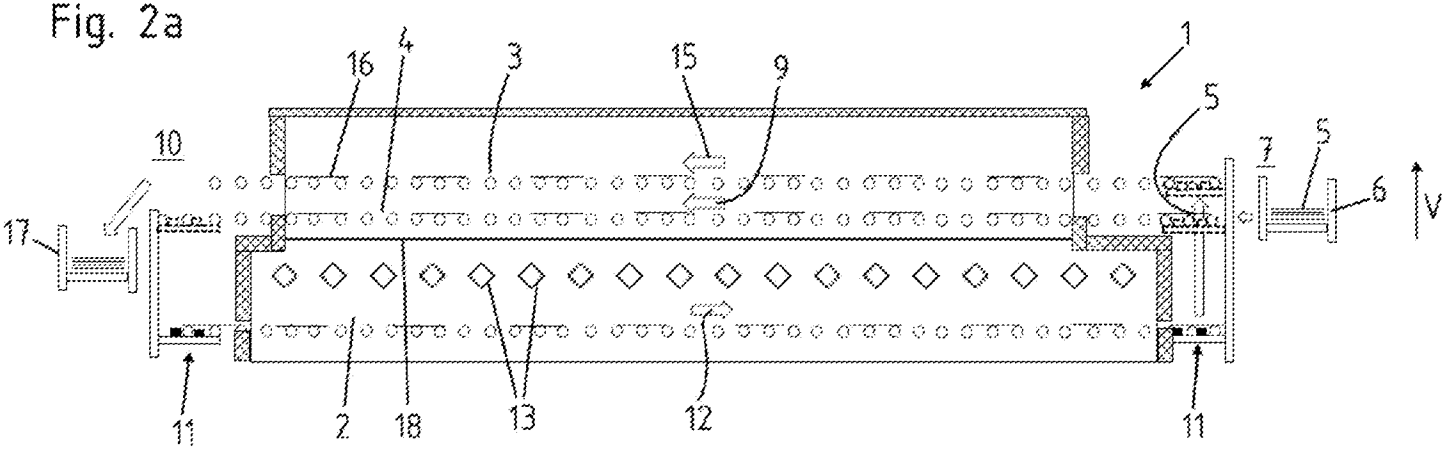
Figure 2B:
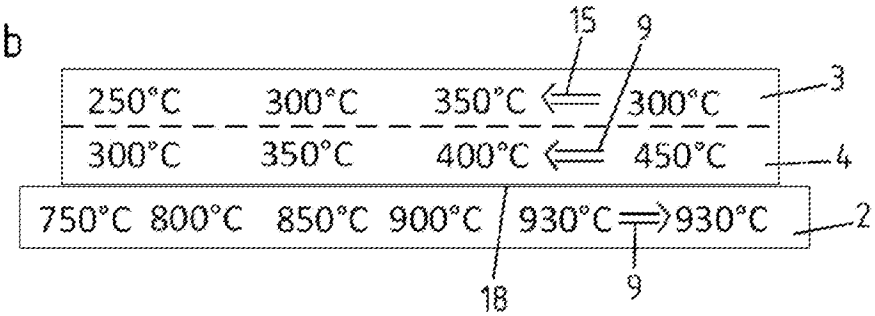
Figure 3A:
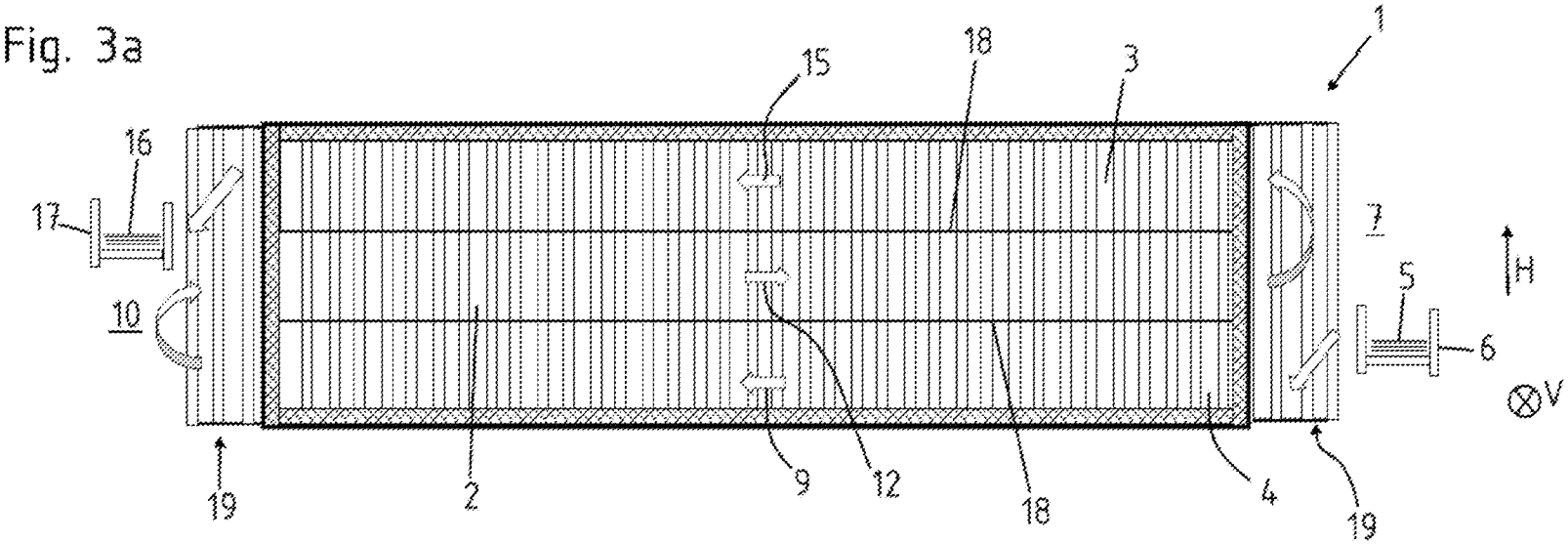
Figure 3B:
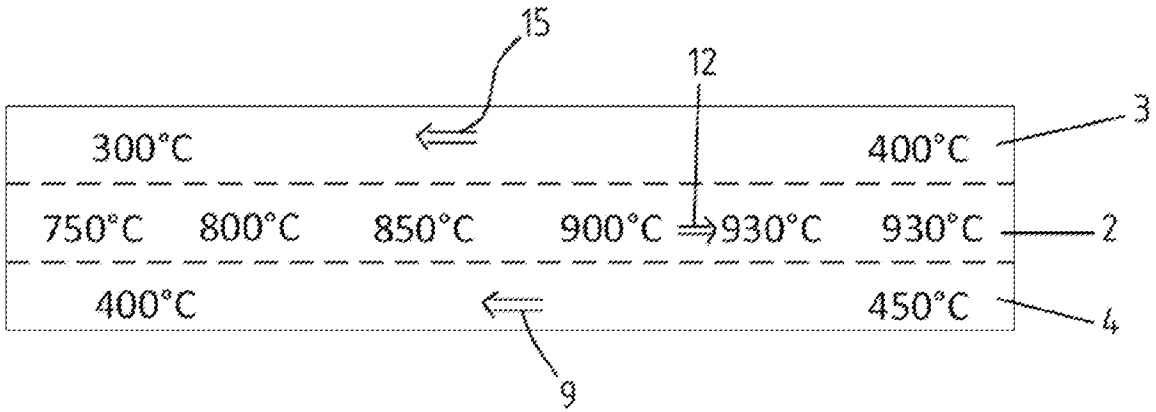
Figure 4A:
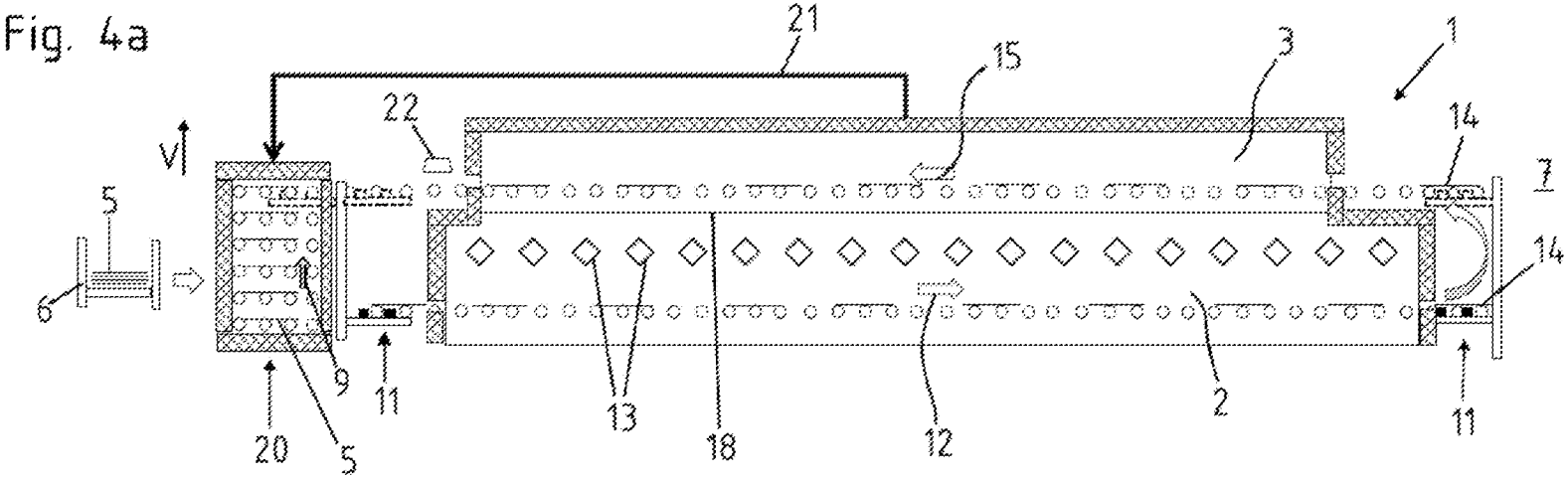
Figure 4B:
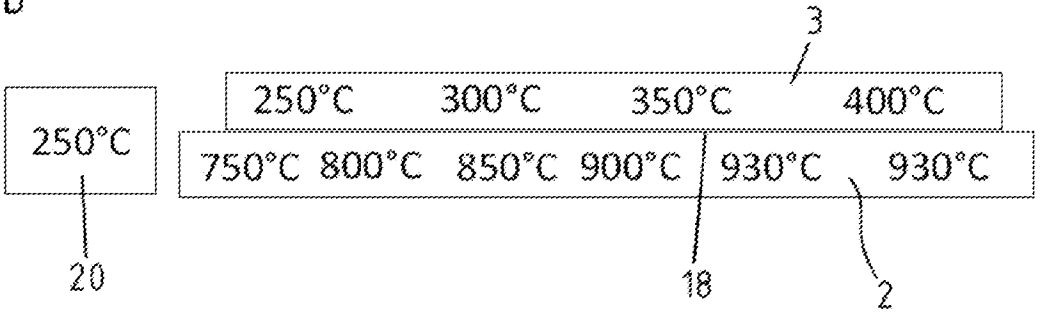
Figure 5A:
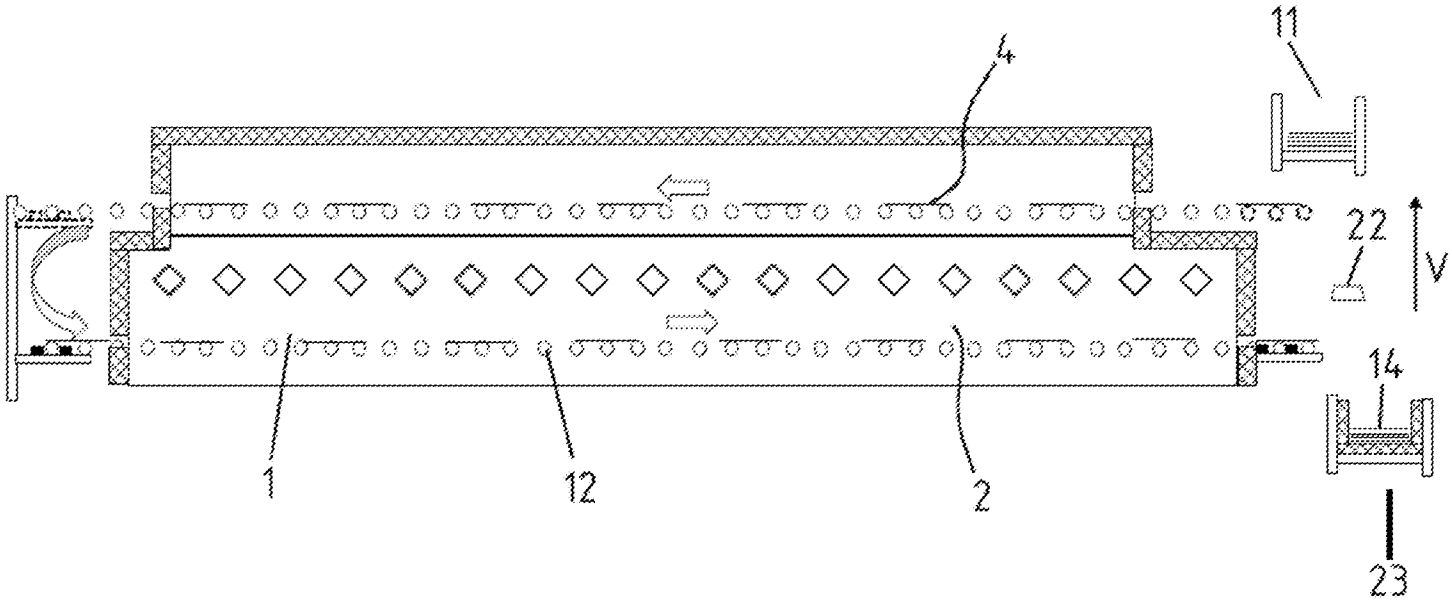
Figure 5B:
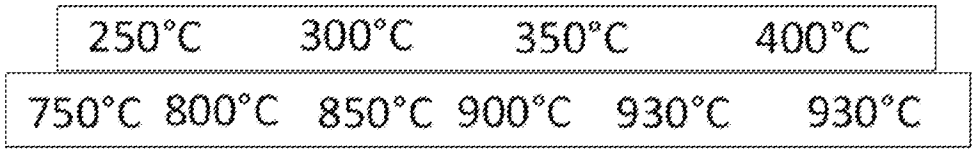
Figure 6:
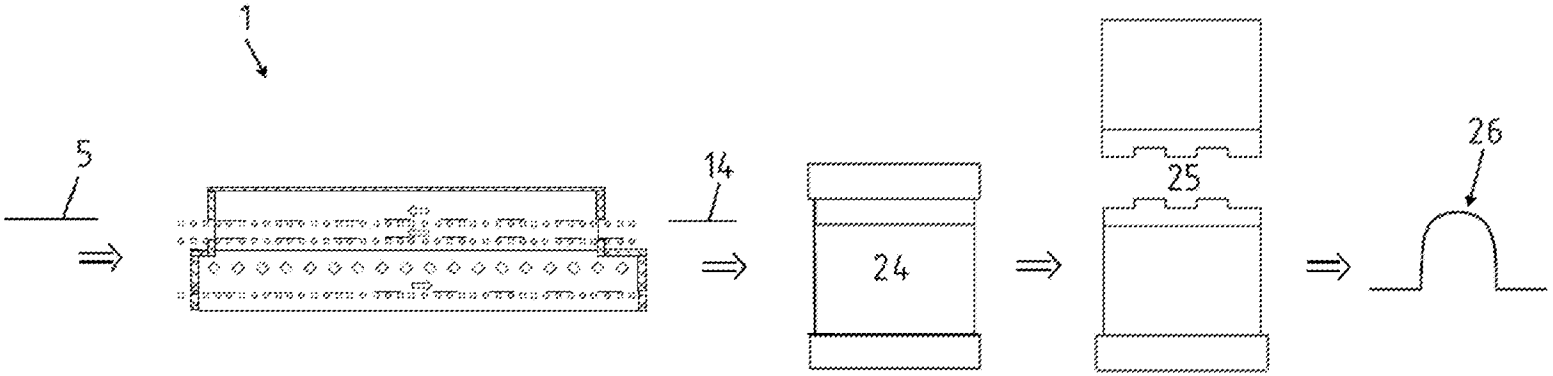

Other advantages, features, properties and aspects of the present invention are dealt with in the following description. Preferred embodiment variants are presented in the schematic figures. These serve to make the invention easy to understand. In the figures:

FIGS. 1*a* and 1*b* show a first variant, according to the invention, of a heat treatment furnace and its temperature profile, FIGS. 2*a* and 2*b* show a second variant, according to the invention, of a heat treatment furnace and its temperature profile, FIGS. 3*a* and 3*b* show a third variant, according to the invention, of a heat treatment furnace and its temperature profile, FIGS. 4*a* and 4*b* show a fourth variant, according to the invention, of a heat treatment furnace and its temperature profile, FIGS. 5*a* and 5*b* show a fifth variant, according to the invention, of a heat treatment furnace and its temperature profile, and FIG. 6 is a view of the method, carried out according to the invention, for producing a motor vehicle part.

The figures use the same reference signs for identical or similar parts, even if a repeated description is omitted for reasons of simplicity.

FIG. 1*a* shows a heat treatment furnace 1 according to the invention in the form of a continuous furnace. This furnace has, in relation to the plane of the image, a metallurgical bonding path 2 at the bottom, a cooling path 3 in the middle and a preheating path 4 at the top. In this regard, pre-coated steel sheet blanks 5 from a stack 6 are introduced into the preheating path 4 at one end 7 of the heat treatment furnace 1. The heat radiation of the steel sheet blanks 16 that are to be cooled and are transported through the cooling path 3 can simultaneously be used to preheat the steel sheet blanks that are to be transported through the preheating path 4. Also depicted is a distance A between the preheating path 4 and the cooling path 3, such that the transfer of heat $\dot{Q}$ takes place in the form of heat radiation from the steel sheet blanks that are to be cooled to the steel sheet blanks that are to be preheated. This distance is preferably 20 to 300 mm.

As transport means 9, rollers 8 can be arranged throughout the furnace. It is however also possible to use other transport means for transit. The pre-coated steel sheet blanks 5 are conveyed through the preheating path 4 in a transport direction of the preheating path 4.

At the opposite end 10 of the heat treatment furnace 1 there is provided a vertical conveyor 11 which lowers the preheated steel sheet blanks 5 (with regard to the plane of the image) and transfers them to the metallurgical bonding path 2. Then, the preheated steel sheet blanks are conveyed through the metallurgical bonding path 2 in the transport direction 12. Heating means 13, for example burners or alternatively induction coils, are arranged in the metallurgical bonding path 2. The preheated steel sheet blanks transported through the metallurgical bonding path 2 are heated, at least at the end of the metallurgical bonding path 2, to a temperature above the Ac3temperature such that the pre-coating forms an intermetallic phase with the steel sheet blank and the steel sheet blanks 14 are metallurgically bonded.

Also provided at the previously described end 7 is a vertical conveyor 11 which raises the metallurgically bonded steel sheet blanks 14 and introduces them into the cooling path 3. In the transport direction 15 through the cooling path 3, the metallurgically bonded steel sheet blanks 14 are cooled to a temperature and removed at the end of the cooling path 3, and the metallurgically bonded and cooled steel sheet blanks 16 are stored on a blank stack 17. These can undergo further processing (not shown in greater detail), in particular a subsequent hot-forming and press-quenching process.

FIG. 1*b* shows an exemplary temperature profile that prevails in the individual paths 2, 3, 4. With regard to the plane of the image, the temperature within the metallurgical bonding path 2 increases from left to right from 750° C. to 930° C. The steel sheet blank conveyed through the metallurgical bonding path 2 thus heats up owing to the furnace temperature prevailing inside the metallurgical bonding path 2, or owing to the effect of heat on the steel sheet blank that is to be heated and metallurgically bonded. A relatively constant temperature of 350° C. prevails in the cooling path 3 and in the preheating path 4. By choosing the transport speed through the preheating path 4 or the cooling path 3, it is thus possible to influence the heating time and the preheating temperature or cooling temperature adopted at the end 7, 10 of the respective path 2, 3, 4. The preheating path 4 and the cooling path 3 have no heating means of their own. To that end, there is provided a separating layer 18 between the metallurgical bonding path 2 and the cooling path 3 and/or the preheating path 4. By prior selection, closed-and/or open-loop control of the separating layer, it is possible to influence the transfer of heat from the metallurgical bonding path 2 into the cooling path 3 and/or the preheating path 4.

FIGS. 2*a* and *b* show an alternative embodiment variant to FIG. 1*a* and *b*. Here, too, the individual paths 2, 3, 4 are arranged stacked one atop the other with regard to the vertical direction V. However, in contrast to FIG. 1, the preheating path 4 is arranged in the middle, the cooling path 3 is arranged at the top and the metallurgical bonding path 2 is again arranged at the bottom, in each case with regard to the plane of the image or the vertical direction V. Thus, the pre-coated steel sheet blanks 5 are once again inserted into the preheating path 4 from a stack 6 at one end 7, pass through the preheating path 4 and are transferred to the metallurgical bonding path 2 by a vertical conveyor 11 arranged at the end of the preheating path 4. Then, the blanks pass through the metallurgical bonding path 2 in the transport direction 12 of the latter, and are once again transferred, at the starting end 7 and by a vertical conveyor 11, to the cooling path 3, in this example raised, and pass through the cooling path 3.

At the end 10 of the cooling path 3, the cooled steel sheet blanks 16 are removed and brought to a blank stack 17. Here, too, heating means 13 are once again provided, both in the metallurgical bonding path 2 and in the thermal separating layer 18, such that heat energy is transferred from the metallurgical bonding path 2 to the preheating path 4 or to the cooling path 3.

The temperature profile of the heat treatment furnace 1 shown in FIG. 2*a* can be seen in FIG. 2*b*.

FIG. 2*b* also shows that, with regard to the plane of the image, the temperature profile of the metallurgical bonding path 2 increases from left to right. The thermal separating layer has the effect that the temperature profiles of the cooling path 3 and the preheating path 4 are less than that of the metallurgical bonding path 2. However, the left-to-right profile, in the plane of the image, also shows how the temperature increases within the path.

FIGS. 3*a* and *b* show an alternative embodiment variant of the heat treatment furnace 1 according to the invention. In this case, the individual paths 2, 3, 4 are arranged lying next to one another in the horizontal direction H. The pre-coated steel sheet blanks 5 are once again inserted into a preheating path 4 from a stack 6 at one end 7 of the heat treatment furnace 1 and pass through the preheating path 4 in the transport direction 9 of the latter. At the end 10, the blanks are transferred, in the horizontal direction H by means of a horizontal conveyor 19, into a parallel metallurgical bonding path 2 and pass through the metallurgical bonding path 2 in the transport direction 12 of the latter, at the starting end 7 the metallurgically bonded steel sheet blanks 14 are transferred, in the horizontal direction H by means of another horizontal conveyor 19, into a cooling path 3 parallel to the metallurgical bonding path 2, and pass through the cooling path 3 in the transport direction 15 of the latter. At the end 10 of the cooling path 3, the cooled steel sheet blanks 16 are removed and are stored on a blank stack 17 such that they can be supplied for another use.

FIG. 3*b* again shows a temperature profile of the parallel, mutually adjacent paths 2, 3, 4. It can be seen that, in the preheating path 4, use is initially made of excess temperature for more rapid preheating of the pre-coated steel sheet blanks 5, then in the metallurgical bonding path 2 the temperature increases from 750° C. to 930° C. internal temperature, and therefore so does that of the blanks passing through the furnace, such that metallurgical bonding takes place. Thereafter, a cooling path 3 is passed through from 400° C. to 300° C. such that controlled cooling of the metallurgically bonded steel sheet blanks 14 to approximately below 350° C. at the end of the cooling path 3 takes place. Both the cooling path 3 and the preheating path 4 are parallel and adjacent to the metallurgical bonding path 2 such that, in this embodiment variant, heating means (not shown) of the metallurgical bonding path 2 accordingly also control the temperature of the cooling path 3 and/or the preheating path 4.

FIG. 4*a* shows a heat treatment furnace 1 with a separate preheating chamber 20, and a metallurgical bonding path 2 and cooling path 3 in the form of a stacked continuous furnace. First, the pre-coated steel sheet blanks 5 are transferred from a stack 6 into the preheating chamber 20. In that context, the preheating chamber 20 is optionally operated using exhaust air 21 from the actual heat treatment furnace 1. The pre-coated steel sheet blanks 5 are transported upwards, in the vertical direction V, in the transport direction 9 through the preheating chamber 20 and thence moved by means of a vertical conveyor 11 back down into the metallurgical bonding path 2. This is once again designed as a continuous furnace with heating means 13 such that the blanks are metallurgically bonded and the metallurgically bonded steel sheet blanks 14 are raised in the vertical direction V by a vertical conveyor 11 at one end 7 of the metallurgical bonding path 2 and transferred to the cooling path 3. The blanks pass through the cooling path 3 in the transport direction 15 of the latter, according to the contraflow principle relative to the metallurgical bonding path 2. Additional cooling means 22, for example cooling plates that can be placed on top, can be provided at the end of the cooling path 3. The metallurgically bonded and cooled steel sheet blanks 16 can then be supplied to further processing or storage.

FIG. 4*b* once again shows a temperature profile of the cooling path 3 and the metallurgical bonding path 2, and of the preheating chamber 20 as shown in FIG. 4*a*.

FIGS. 5*a* and *b* show a further alternative embodiment variant with a preheating path 4 and a metallurgical bonding path 2 arranged below this in the vertical direction V, and an exemplary temperature profile. Shown here are a preheating path 4 and a metallurgical bonding path 2. A cooling means 22 is provided at the end of the metallurgical bonding path 2. Alternatively or in addition to the cooling means 22, there is provided an insulated transport frame 23 into which the metallurgically bonded steel sheet blanks 14 are placed and then cooled in a targeted manner therein. The cooling rate can be influenced by the thickness of the insulation material of the insulated cooling frame.

In FIG. 6, a pre-coated steel sheet blank 5 is first conveyed to a heat treatment furnace 1. After passing through the heat treatment furnace 1, this steel sheet blank 14 is metallurgically bonded and is conveyed to a tempering station 24 where rapid heating takes place. The metallurgically bonded steel sheet blank 14, which is tempered, at least in certain regions, to above Ac3 with the rapid heating, is then conveyed to a combined hot-forming and press-quenching tool 25 where it is hot-formed and quenched by rapid cooling. This produces a motor vehicle part 26 in accordance with the invention, which part has, owing to the heat treatment according to the invention, both an anti-corrosion layer and also reduced cracking tendency. The method can in particular be used for steel sheet blanks made of AlSi-precoated sheet metal strips with regionally reduced sheet thickness in the rolling direction of strips, also termed Tailor Rolled Blanks. In particular, the regions with a greater reduction in thickness and thinner sheet thickness are less susceptible to cracking and/or breakage owing to the low hydrogen content. Rolling is ideally performed as cold rolling. It is thus possible to produce coated parts with a load-appropriate sheet thickness profile without a tendency to crack. With the method, it is also possible to produce other steel parts with at least two regions of different thicknesses. The above-mentioned advantages apply accordingly.

The invention claimed is:

1. Method for heat treatment of a pre-coated steel sheet blank, in which a pre-coating is provided on a steel sheet blank, the method comprising:

preheating the pre-coated steel sheet blank to a preheat temperature between 200° C. and 450° C., then heating the preheated, pre-coated steel sheet blank to a metallurgical bonding temperature above an austenizing temperature, such that the pre-coating is metallurgically bonded to the steel sheet blank to form a coating, then cooling the metallurgically bonded steel sheet blank to a cooling temperature of less than 450° C. at a cooling rate of greater than 30 s per millimeter of sheet thickness of the steel sheet blank, and then hot-forming and press-hardening the cooled, metallurgically bonded steel sheet blank, wherein the metallurgically bonded steel sheet blank has, in at least one region, a fraction of atomic hydrogen below 0.5 ppm.

2. Method according to claim 1, wherein the preheat temperature is between 250° C. to 450° C., and/or the cooling temperature is between 450° C. and 300° C.

3. Method according to claim 1, wherein the heating to the metallurgical bonding temperature is performed as rapid heating at a heating rate of less than 20 s per mm of sheet thickness of the steel sheet blank to be heated.

4. Method according to claim 1, wherein a thickness of the coating is between 0.6 μm and 0.15 μm and/or the fraction of atomic hydrogen is below 0.3 ppm.

5. Method according to claim 1, wherein the steel sheet blank is of a quenchable steel alloy, the pre-coating is of an Al—Si alloy, and at least an intermetallic phase of Fe—Al is formed when the pre-coating is metallurgically bonded to the steel sheet blank.

6. Method according to claim 1, wherein heat radiation of metallurgically bonded steel sheet blanks that are guided through a cooling path during the cooling is used to preheat other, pre-coated steel sheet blanks that are guided through a preheating path during the preheating.

7. Method according to claim 1, wherein the heating to metallurgical bonding temperature is performed as rapid heating at a heating rate of less than 5 s per mm of sheet thickness of the steel sheet blank to be heated.

8. Method according to claim 1, wherein the cooling temperature is between 450° C. and 300° C., and the method further comprises a further cooling process to cool the metallurgically bonded steel sheet blank to a temperature of less than 300° C.

9. Method for producing a hot-formed and press-quenched motor vehicle part, the method comprising:

preheating a pre-coated steel sheet blank, in which a pre-coating is provided on a steel sheet blank, to a preheat temperature between 200° C. and 450° C., then heating the preheated, pre-coated steel sheet blank to a metallurgical bonding temperature above an austenizing temperature, such that the pre-coating is metallurgically bonded to the steel sheet blank to form a coating, then cooling the metallurgically bonded steel sheet blank to a cooling temperature of less than 450° C. at a cooling rate of greater than 30s per millimeter of sheet thickness of the steel sheet blank, then reheating the cooled, metallurgically bonded steel sheet blank at least partially, in a time of less than 20 s, to a temperature greater than or equal to the austenizing temperature, and then hot-forming and press-quenching the reheated, metallurgically bonded steel sheet blank into the hot-formed and press-quenched motor vehicle part, wherein the metallurgically bonded steel sheet blank has, in at least one region, a fraction of atomic hydrogen below 0.5 ppm.

10. Method according to claim 9, wherein in the reheating, the cooled, metallurgically bonded steel sheet blank is reheated from the cooling temperature, or from room temperature.

11. Method according to claim 9, wherein the produced motor vehicle part has, in at least one region, a tensile strength Rm of greater than 1250 MPa, and/or the fraction of atomic hydrogen is below 0.3 ppm.

12. Method according to claim 11, wherein the tensile strength Rm is greater than 1450 MPa.

13. Method according to claim 1, wherein the heating to the metallurgical bonding temperature is performed as rapid heating at a heating rate of less than 10 s per mm of sheet thickness of the steel sheet blank to be heated.

* * * * *